US008132383B1

(12) United States Patent
Herrmann et al.

(10) Patent No.: US 8,132,383 B1
(45) Date of Patent: Mar. 13, 2012

(54) CLIP FOR ATTACHING TO COLUMN OR BEAM

(75) Inventors: John C. Herrmann, Raleigh, NC (US); Nabil Abdel-Rahman, Raleigh, NC (US); Thomas C. Boyd, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 92 days.

(21) Appl. No.: 12/819,368

(22) Filed: Jun. 21, 2010

(51) Int. Cl.
*E04B 2/30* (2006.01)

(52) U.S. Cl. ..... 52/489.1; 52/712; 52/834

(58) Field of Classification Search ..... 52/489.1, 52/834, 712, 714, 698; 24/289
See application file for complete search history.

(56) References Cited

U.S. PATENT DOCUMENTS 3,748,815 A * 7/1973 Parker ..... 52/714
4,484,427 A * 11/1984 Crites et al. ..... 52/261
6,067,691 A * 5/2000 Feltman ..... 24/295
6,637,172 B2 * 10/2003 Bousquet ..... 52/714

* cited by examiner

*Primary Examiner* — Brian Glessner
*Assistant Examiner* — Paola Agudelo
(74) *Attorney, Agent, or Firm* — Coats & Bennett, P.L.L.C.

(57) ABSTRACT

A metal clip is provided for facilitating the attachment of metal strips and wallboard to columns and beams. The metal clip includes a base section and a spring retainer extending from the base section. A portion of a column or beam, such as flange, can be inserted between the spring retainer and the base section and the spring retainer will exert sufficient force on the column or beam to hold the metal clip in place. A pair of foldout clips is formed on exterior surfaces of the metal clip for receiving and holding angle strips. Wallboard can be secured exteriorly of the metal clips and angle strips by screws that extend through the wallboard, through the angle strips and into the respective metal clips.

15 Claims, 3 Drawing Sheets

CLIP FOR ATTACHING TO COLUMN OR BEAM

FIELD OF THE INVENTION

The present invention relates to clips, and more particularly to a metal clip that is designed to attach to a flange or other portion of a column or beam such that angle strips and/or wallboard can be easily secured via the clips to the column or beam.

BACKGROUND OF THE INVENTION

In constructing buildings it is a common practice to utilize columns and beams and box-in the columns or beams with wallboard for aesthetic reasons and/or for fire protection of the structural members. In some cases to meet fireproofing standards (UL 263 for example) there is a requirement to utilize continuous vertical angle strips about the corners of such enclosures. Typically these angle strips include two flanges with each flange being approximately one and one-half inch wide. Typically these angle strips are constructed of light gauge (for example, 25 gauge) metal. Thus, it is appreciated that if an I-beam, for example, is being closed that there would be provided a metal strip adjacent each corner of the enclosure. It is difficult and time consuming to properly secure these angle strips to the column or beam. Holding the angle strips in place prior to hanging the gypsum board is difficult to manage. In some cases the angle strips are secured to clips by screws. This calls for more work by installers and also results in screw heads over which the gypsum board must be placed. This is not desired when hanging wallboard.

Therefore, there is a need for an attaching mechanism that enables angle strips and wallboard to be efficiently secured around columns and beams.

SUMMARY OF THE INVENTION

The present invention relates to a metal clip for attaching angle strips and wallboard to a column or beam. In one embodiment, the metal clip includes a base section and a spring retainer extending adjacent the base section. The spring retainer is at least slightly flexible such that a portion, such as a flange, of a column or beam can be inserted between the base section and the spring retainer. The spring retainer will supply sufficient force against the portion of the column or beam so as to maintain the metal clip on the column or beam. One or more foldout clips are provided on the metal clip. These foldout clips are open such that they can receive and hold angle strips that extend along the corners of the column or beam. In one embodiment, wallboard is attached by screws that extend through the wallboard, through the angle strips, and into the metal clip.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, the metal clip of the present invention is shown therein and indicated generally by the number 10. Clip 10 can be constructed in various ways but in one embodiment the clip comprises a one-piece construction made of light gauge metal. Various gauges of metal may be utilized but in one embodiment a 22 gauge metal material is used.

Metal clip 10 is designed to be attached to a load bearing member such as a column or beam. As discussed subsequently herein, the metal clip is designed to receive and hold angled strips that are typically disposed along corner areas of the column or beam. In addition, the metal clip 10 serves as a structure for attaching wallboard thereto. As discussed subsequently herein, in one embodiment, screws or other types of fasteners are utilized to screw into and through the wallboard, through the angle strips and into the respective metal clips 10.

Figure 1:
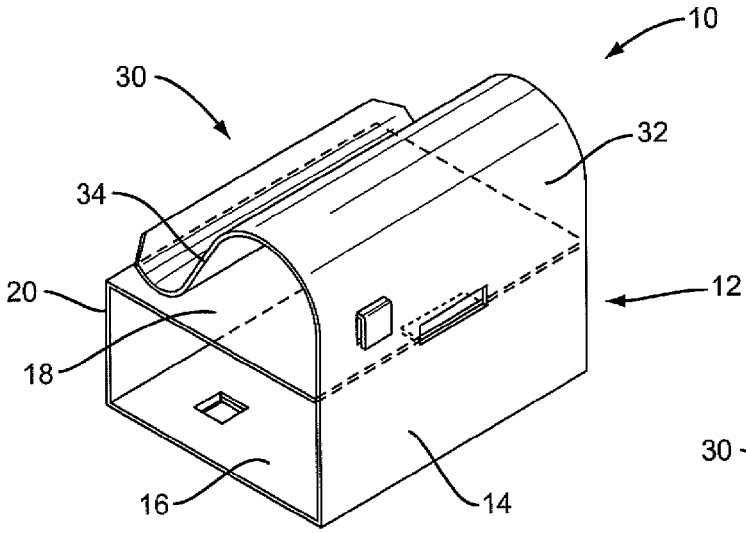
FIG. 1 is a perspective view of the metal clip of the present invention.
Figure 2:
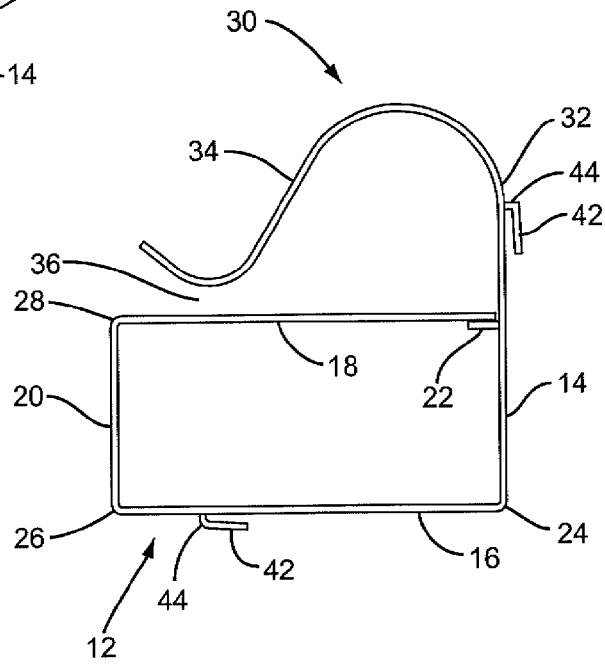
FIG. 2 is a side elevation view of the metal clip.

Viewing the metal clip 10 in more detail, the same includes a base section indicated generally by the number 12. In the embodiment illustrated herein the base section 12 assumes a generally rectangular open frame. The rectangular open frame includes a series of sides, and in the case of the embodiment illustrated herein, includes a first side 14, a second side 16, a third side 18, and a fourth side 20. As shown in FIG. 2, the rectangular open frame includes an inner tab 22 that is disposed in one inner corner of the base frame 12. Further, the base frame or the rectangular open frame includes a series of corners 24, 26, and 28.

Extending from the base section 12 is a spring retainer indicated generally by the number 30. Spring retainer 30 includes a side portion 32 and a curled portion 34. Side portion 32 generally aligns with the first side 14 of the base section 12. Curled portion 34, as viewed in FIG. 2, generally overlies the third side 18 of the base section 12. Note in FIG. 2 where the terminal end of the curled portion 34 is spaced outwardly or above the third side 18 of the base section. An open space 36 is defined generally between the curled portion 34 and the third side 18 of the base section 12. Furthermore, the curled portion 34 is in the form of a spring retainer and is flexible such that it can move back and forth with respect to the base section 12. As will be discussed later, a flange or other portion of a column or beam can be inserted between the spring retainer 30 and the base section 12 and because of the resilient or flexible nature of the spring retainer 30, the metal clip 10 can be held on the column or beam.

Figure 3:
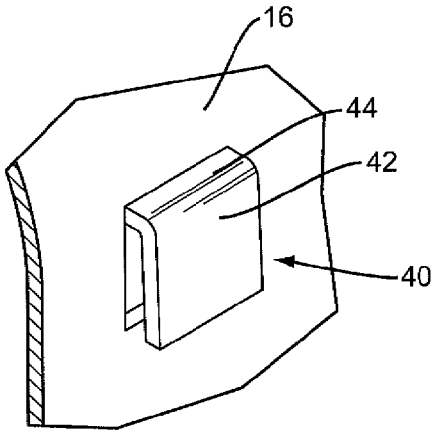
FIG. 3 is a fragmentary perspective view showing one foldout clip that is formed in the metal clip.

Metal clip 12 includes one or more clips 40. The clips 40 are sometimes referred to as foldout clips or angle strip clips. The function of the clips 40 is to engage and retain portions of angle strips that extend along corner portions of the load bearing member that receives the metal clips 10. The terms "clip", "foldout clip", and "angle strip clip" all mean a clip or fastener for engaging an angle member and retaining the angle member. Each clip 40 assumes a generally L-shape and includes a back 42 and a connector 44 extending from the back. As seen in FIG. 3, each clip 40 in one embodiment is formed by cutting the same from a portion of the metal clip 10 and bending the cut portion outwardly. Note in FIG. 3 where the connector 44 extends from the metal clip 10 and effectively connects the back 44 to a portion of the metal clip 10.

In the case of the embodiment illustrated herein, one clip 40 is formed on the side portion 32 of the spring retainer 30 and another clip is formed on the second side 16 of the base section 12. Both clips 40 include an open edge that enables an angle strip or other structure to slide underneath the back 42 and be retained thereby. The clip 40 is designed such that the back 42 is spaced a selected distance from side 16 of the base section or the side portion 32 of the spring retainer 30. Preferably, the spacing of the back 42 is such that when a structure is moved into engagement with the back that the back can flex and functions to frictionally hold the structure adjacent the metal clip 10. In the case of the embodiment shown in FIGS. 1-7, the open edge of the clips 40 face the corner 24. Clips 40 are generally disposed so as to receive structures that lie in planes that are generally separated by approximately 90 degrees. Other angular relationships can be formed.

Figure 4:
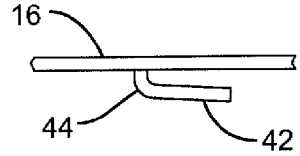
FIG. 4 is a fragmentary view showing one of the foldout clips.
Figure 5:
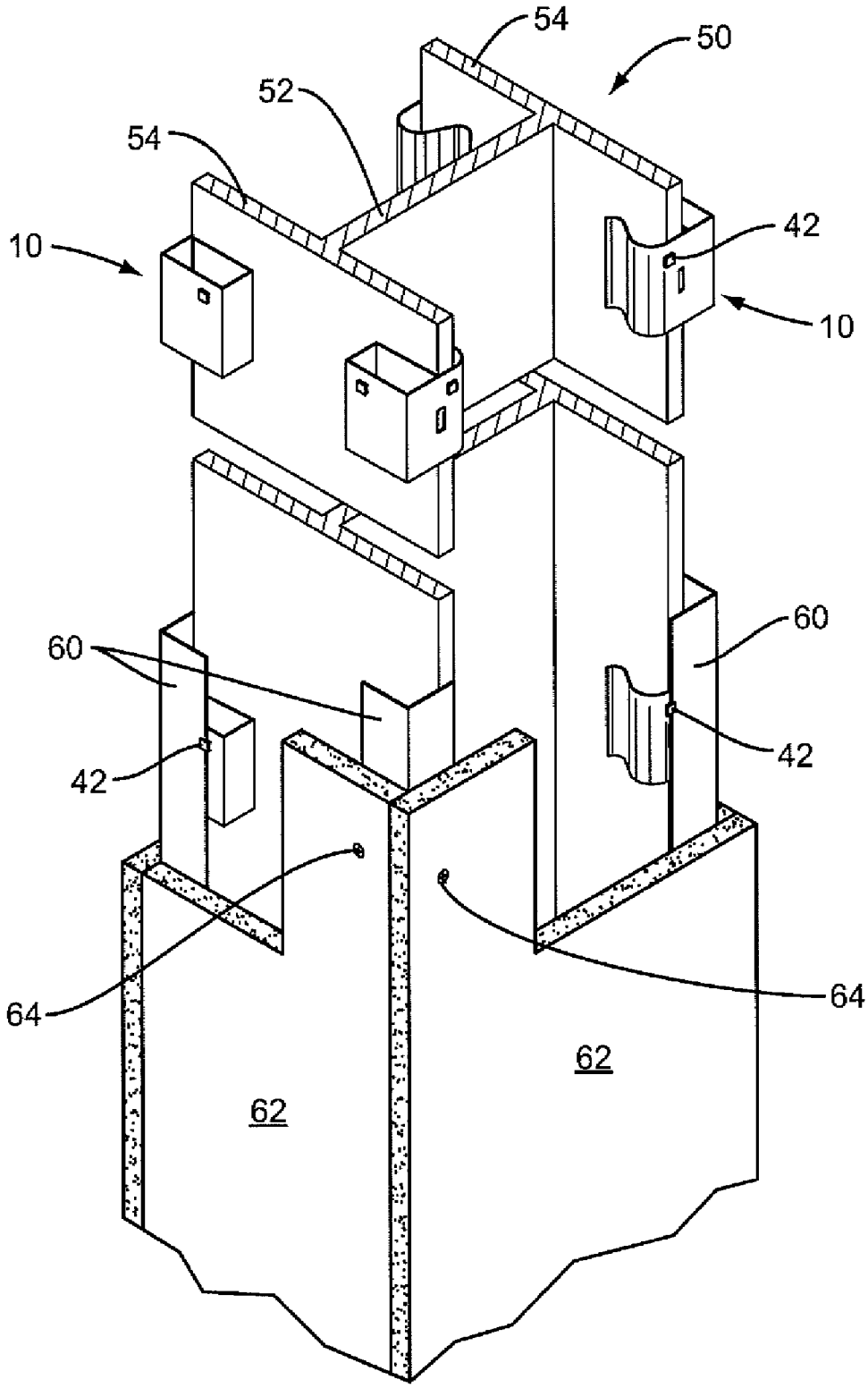
FIG. 5 is a perspective view of a column or beam with portions broken away to better illustrate how the metal clip is secured to a portion of the column or beam and how the metal clips functions to retain angle strips.
Figure 6:
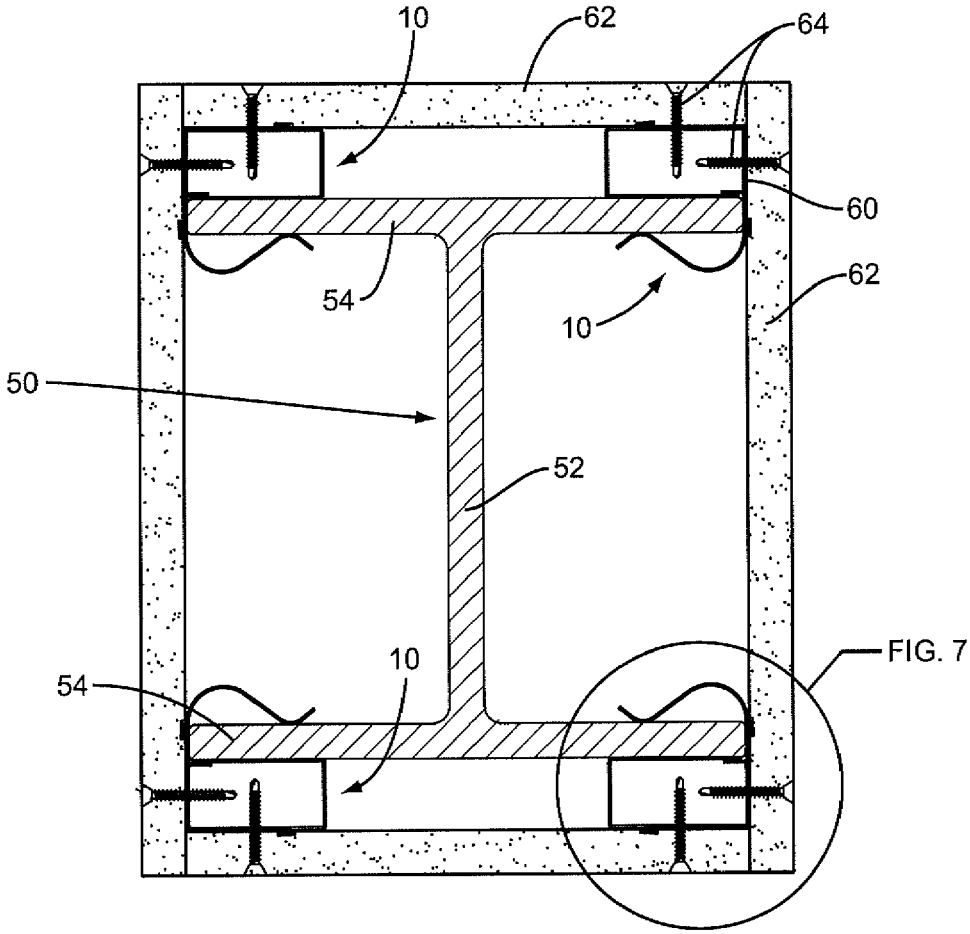
FIG. 6 is a cross-sectional view of a column or beam illustrating the metal clips attached to the column or beam.
Figure 7:
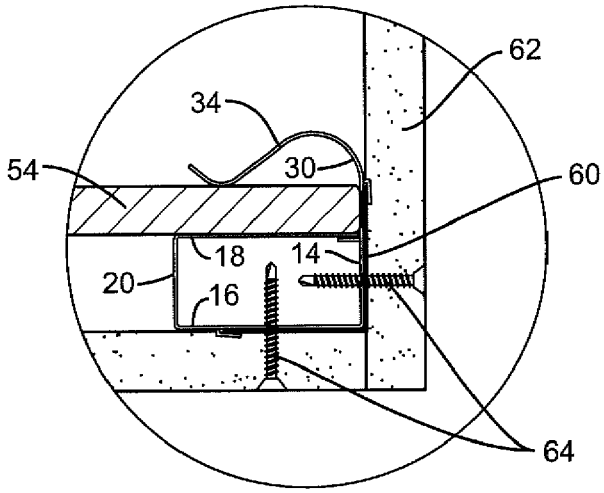
FIG. 7 is an enlarged view of the circled portion shown in FIG. 6.

FIG. 5 illustrates how the metal clips 10 are used in conjunction with a column or beam. Note in FIG. 5 that the column or beam is in the form of an I-beam indicated generally by the numeral 50. I-beam 50 includes a web 52 and a pair of flanges 54. Metal clips 10 are clamped onto the flanges 54 of the I-beam 50. In this embodiment, the clips 10 are secured to both flanges and a series of the clips are spaced apart and aligned along one edge portion of the respective flanges 54. Spacing of the metal clips 10 can vary. However, as shown in FIG. 4, for this type of design, the metal clips 10 are secured to opposed portions of each flanges 54.

To secure a metal clip 10 to a portion of a flange 54, the clip 10 is oriented such that the opening 36 between the spring retainer 30 and the base section 12 is aligned with the flange 54 and the clip is simply pushed into place. Flange 54 will typically engage a portion of the curled portion 34 and cause the curled portion to flex and open such that the flange can be inserted between the curl portion and the third side 18 of the base section 12. The curled portion 34 is designed such that when a portion of a flange 54 is inserted into the metal clip 10, the curled portion 34 will exert a holding force on the flanges 54 of the I-beam 50 sufficient to stationarily hole the metal clip in place. The force exerted by the spring retainer 30 and particularly the curled portion 34 is sufficient to hold the meal clip 10 in place even while the clip 40 may be holding and retaining an angled structure.

As discussed earlier, it is advantageous, or in some cases even required, that a column or beam such as shown in FIG. 5 include metal angle strips 60 about the respective corners of the structure. In the case of the design shown in FIG. 5, there is provided four angle strips 60 about respective corners of the I-beam 50. Each angle strip 60 is held in place by a series of generally aligned metal clips 10 secured to the flanges 54 of the I-beam. More particularly, the angle strips 10 are inserted into the clips 40. This is particularly illustrated in FIG. 5. The frictional hold realized by the clips 40 on the angle strips 60 is generally sufficient to hold the angle strips in place while boxing-in the I-beam. After the angle strips 60 have been placed around the respective corners of the column or beam, the wallboard 62 can be applied. Each wallboard 62 is secured by a series of fasteners 64 that are screwed through the wallboard, through the angle strips 60 and into a portion of the metal clips 10. This construction is illustrated in the sectional views of FIGS. 6 and 7. Note how the fasteners 64, which are typically self-tapping screws, extend through the wallboard 62, through the angle strips 60 and into the sides 14 and 16 of the base section 12 of the metal clips 10.

From the foregoing discussion, it is appreciated that the metal clips 10 of the present invention are useful in boxing-in a beam or column and are particularly useful in retaining corner or angle strips about the beam or column while the wallboard is being attached.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A metal clip for attaching angle strips and wallboard to a column or beam, the metal clip comprising:

a. an open rectangular frame having first, second, and third sides wherein the first and second sides are exposed when the clip is mounted to the column or beam, and wherein the third side is configured to lie adjacent a portion of the column or beam;

b. a spring retainer extending from the rectangular frame and including a side portion and a curled spring, and wherein the curled spring is spaced from the third side of the rectangular frame so as to define a space therebetween for receiving a portion of the column or beam;

c. a pair of foldout clips formed in the metal clip for receiving and holding an angle strip adjacent the column or beam; and d. wherein one of the foldout clips is formed in the side portion of the spring retainer and the other foldout clip is formed in one of the first or second sides of the rectangular frame.

2. The metal clip of claim 1 wherein the first side of the rectangular frame is generally aligned with the side portion of the spring retainer, and wherein the second side of the rectangular frame extends generally parallel with the third side of the rectangular frame; and wherein one foldout clip is formed in the side portion of the spring retainer, and the other foldout clip is formed in the second side of the rectangular frame.

3. The metal clip of claim 2 wherein each foldout clip includes an open edge that enables an angle strip to slide into the foldout clip, and wherein the open edges of the foldout clips face a corner that is formed between the first and second sides of the rectangular frame.

4. The metal clip of claim 1 wherein the rectangular frame and spring retainer constitute a single piece of metal, and wherein the single piece of metal includes a plurality of corners and at least one curved segment.

5. The metal clip of claim 1 wherein each foldout clip includes a back and a connector, and wherein the connector extends from the back and connects to one of the sides of the rectangular frame or to the side portion of the spring retainer, and wherein there is an open space defined between the back and one of the sides of the rectangular frame or the side portion of the spring retainer.

6. The metal clip of claim 1 wherein a series of the metal clips is secured to an I-beam that forms the column or beam, and wherein the I-beam includes a web interconnected between opposed flanges; and wherein each metal clip is secured to at least a portion of one flange by inserting the portion of the flange between the rectangular frame and the spring retainer such that the pair of foldout clips lie exteriorly of the I-beam.

7. The metal clip of claim 6 further including a series of angle strips secured about the I-beam by the metal clips, and wherein each angle strip is secured to the I-beam by a series of generally aligned metal clips, and wherein the angle strip is engaged and held by the foldout clips of the respective metal clips.

8. The metal clip of claim 7 including a series of wallboard pieces secured about the I-beam by a series of fasteners extending through the wall board pieces, through the angle strips, and into the metal clips.

9. The metal clip of claim 1 wherein a series of metal clips is secured to a load-bearing structure that forms a column or beam, and wherein the load-bearing structure includes flanges, and wherein each metal clip is secured to at least one flange of the load-bearing structure by inserting the flange between the rectangular frame and the spring retainer such that the pair of foldout clips lie exteriorly of the load-bearing structure.

10. The metal clip of claim 9 further including a series of angle strips secured about the load-bearing structure by the metal clips, and wherein each angle strip is secured to the load-bearing structure by a series of generally aligned metal clips, and wherein the angle strip is engaged and held by the foldout clips of the respective metal clips.

11. A metal clip attachable to a column or beam for receiving an angle strip and supporting the angle strip about the column or beam, the metal clip comprising:

a. a base section having a plurality of sides;

b. a flexible spring retainer disposed adjacent the base section, and wherein the spring retainer can flex and move back and forth with respect to the base section, and wherein the spring retainer and base section are operative to receive a portion of the column or beam therebetween, and the spring retainer is operative to exert a force against the portion of the column or beam such that the metal clip is held in place on the column or beam;

c. at least two spaced apart angle strip clips formed on the metal clip for receiving and holding the angle strip;

d. each angle strip clip having an open side edge, and further including an open space wherein the angle strip can slide into the angle strip clip and into the open space formed therein; and e. the two angle strip clips are disposed adjacent exterior surfaces of the metal clip, and wherein the two angle strip clips are disposed in two separate planes disposed at a generally 90° angle with respect to each other such that the two angle strip clips can engage and hold the angle strip adjacent the column or beam.

12. The metal clip of claim 11 wherein one angle strip clip is formed on the base section, and one angle strip clip is formed on the spring retainer, and wherein the open side edge of each angle strip clip faces a corner formed in the base section.

13. The metal clip of claim 12 wherein each angle strip clip assumes a generally L-shape and includes a back that is spaced outwardly from a side of the base section, or outwardly from a portion of the spring retainer.

14. The metal clip of claim 13 wherein the open side edge of each angle strip clip faces a corner formed in the base section.

15. The metal clip of claim 11 wherein there is provided a series of metal clips attached to the column or beam; and wherein, along corners of the column or beam a series of angle strips are disposed and held within the angle strip clips; and a series of wallboard pieces surrounding the column or beam wherein the wallboard pieces are secured to the column or beam by fasteners that extend through the wallboard, through the respective angle strips and into the metal clips.

* * * * *